US007743685B2

(12) United States Patent
Chang

(10) Patent No.: US 7,743,685 B2
(45) Date of Patent: Jun. 29, 2010

(54) RATCHET WRENCH

(76) Inventor: Chih-Min Chang, No. 10, Chin Tun Lane, Chin Tun Village, Hua Ten Hsian, Changhua Hsien (TW) 001444

( * ) Notice: Subject to any disclaimer, the term of this patent is extended or adjusted under 35 U.S.C. 154(b) by 0 days.

(21) Appl. No.: 11/958,044

(22) Filed: Dec. 17, 2007

(65) Prior Publication Data

US 2009/0049957 A1 Feb. 26, 2009

(30) Foreign Application Priority Data

Aug. 23, 2007 (TW) ..... 96214050 U

(51) Int. Cl.
*B25B 23/16* (2006.01)

(52) U.S. Cl. ..... 81/177.8

(58) Field of Classification Search ..... 81/177.8, 81/177.6, 177.7
See application file for complete search history.

(56) References Cited

U.S. PATENT DOCUMENTS 2,978,938 A * 4/1961 Nalley ..... 81/177.8
6,557,442 B1 * 5/2003 Owoc ..... 81/177.9
7,424,839 B2 * 9/2008 Chiang ..... 81/177.8

* cited by examiner

*Primary Examiner*—David B Thomas
(74) *Attorney, Agent, or Firm*—Browdy and Neimark, PLLC

(57) ABSTRACT

A ratchet wrench includes a handle having two spaced pivoting walls, two through holes respectively formed through the pivoting walls, and an inner threaded section provided at one of the through holes with a length shorter than the total length of the through hole. A ratchet head has a pivoting portion disposed between the pivoting walls of the handle and a pivoting hole through two opposite sides of the pivoting portion. A screw runs through the through holes of the handle and the pivoting hole of the ratchet head and is threaded with the inner threaded section of the handle. An urging member is disposed in an accommodation chamber of the ratchet head and sleeved onto the screw with two ends thereof stopped against a periphery wall of the accommodation chamber of the ratchet head and the pivoting wall of the handle.

4 Claims, 2 Drawing Sheets

RATCHET WRENCH

BACKGROUND OF THE INVENTION

1. Field of the Invention

The present invention relates generally to a ratchet wrench and more specifically, to a ratchet wrench that has an improved structure strength.

2. Description of the Related Art

FIG. 1 shows a conventional ratchet wrench 1, which comprises a handle 2 and a ratchet head 3 pivotally connected with the handle 2. The handle 2 has two spaced pivoting walls 4 defining a receiving space therebetween at one end of the handle 2. One of the pivoting walls 4 has a threaded through hole 5 and the other has a T-shaped through hole 6, i.e. a counterbore through hole. The ratchet head 3 has a pivoting portion 7 pivotally mounted in the receiving space between the two pivoting walls 4 of the handle 2 by means of a screw 9 running through the T-shaped through hole 6 of the handle 2 and a through hole 8 of the pivoting portion 7 of the ratchet head 3 and threaded with the threaded through hole 5 of the handle 2. When the ratchet wrench 1 is in use, the operation force applied from a user on the handle 2 will be transmitted to the ratchet head 3 through the two pivoting walls 4 for enabling the ratchet head 3 to rotate and fix a workpiece.

As shown in FIG. 1, the threaded through hole 5 of the handle 2 is smaller in diameter than the T-shaped through hole 6 of the handle 2 because of the existence of the threads. Thus, when the strength is transmitted from the handle 2 to the ratchet head 3, an uneven distribution of stress will be exerted on a top section of the screw 9, which is located at the T-shaped hole 6 of the handle 2, and a bottom section of screw 9, which is located at the threaded hole 5 of the handle 2, such that the screw 9 may be broken after the ratchet wrench 1 is used for a long time. Further, the stress concentration will be generated between the screw 9 and one end of the threaded hole 5 of the handle 2 close to the pivoting portion 7 of the ratchet head 3, resulting in acceleration of destruction of the screw 9. Thus, it is desirable to provide a ratchet wrench that can eliminate the aforesaid drawbacks.

SUMMARY OF THE INVENTION

The present invention has been accomplished in view of the above-noted circumstances. It is therefore one objective of the present invention to provide a ratchet wrench, which can reduce stress concentration for strengthening its structure strength.

To achieve this objective of the present invention, the ratchet wrench comprises a handle, a ratchet head, a screw and an urging member. The handle has two spaced pivoting walls at one end thereof, each of which has a through hole through two opposite sides thereof. One of the through holes has an inner threaded section that is smaller in length than the through hole. The ratchet head has a pivoting portion pivotally disposed between the two pivoting walls of the handle, a pivoting hole through two opposite sides of the pivoting portion in alignment with the through holes of the handle, and an accommodation chamber recessed inwards at one side of the pivoting portion. The screw runs through the through holes of the handle and the pivoting hole of the ratchet head and threaded with the inner threaded section of the handle such that the ratchet head is pivotable about the screw relative to the handle. The urging member is disposed in the accommodation chamber of the ratchet head and sleeved onto the screw with two ends thereof stopped against a periphery wall of the accommodation chamber of the ratchet head and one of the pivoting walls of the handle.

According to this design, the ratchet wrench of the present invention can effectively eliminate the influence of the uneven distribution of stress and the stress concentration on the two pivoting walls of the handle by means of reducing the length of the threaded section, thereby enhancing the structure strength of the ratchet wrench of the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below and the accompanying drawings which are given by way of illustration only, and thus are not limitative of the present invention, and wherein.

DETAILED DESCRIPTION OF THE INVENTION

Figure 1:
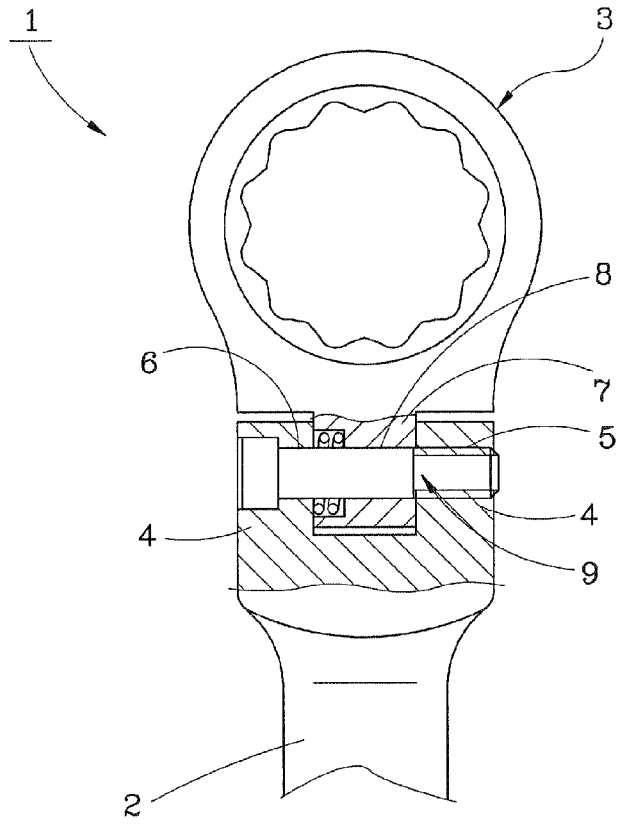
FIG. 1 PRIOR ART
FIG. 1 is a top and partially cutaway view of a ratchet wrench according to a prior art.
Figure 2:
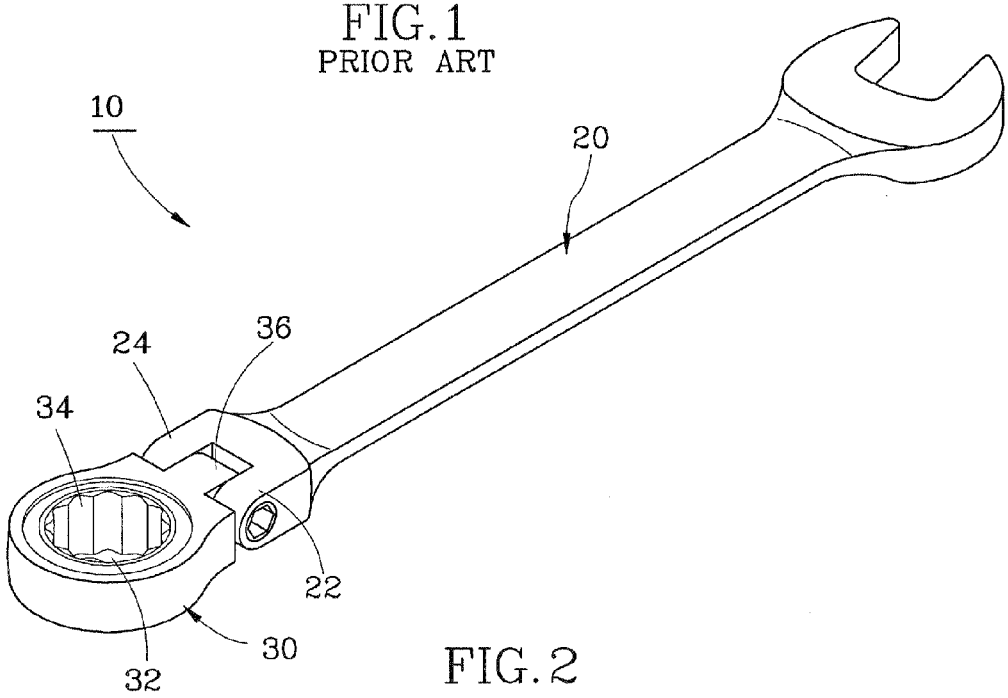
FIG. 2 is a perspective view of a ratchet wrench according to a preferred embodiment of the present invention.
Figure 3:
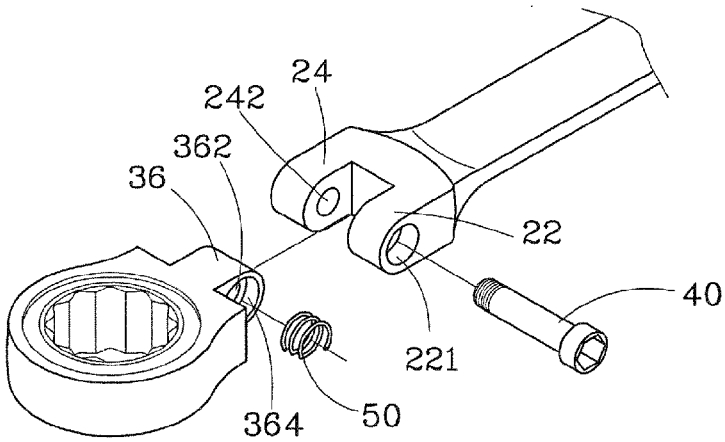
FIG. 3 is an exploded view of the ratchet wrench according to the preferred embodiment of the present invention.
Figure 4:
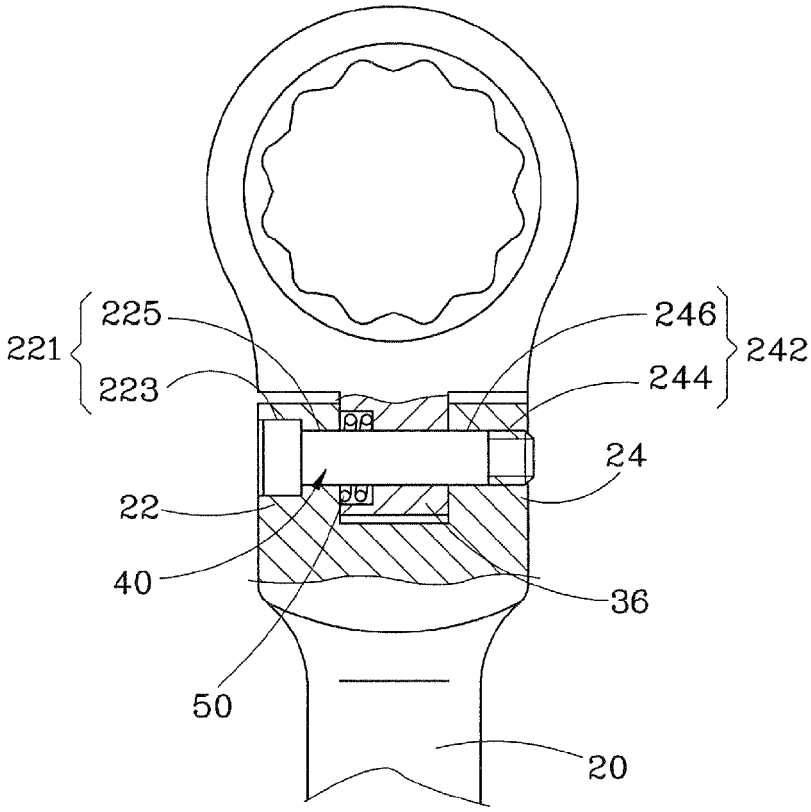
FIG. 4 is a top and partially cutaway view of the ratchet wrench according to the preferred embodiment of the present invention.

Referring to FIG. 2 to FIG. 3, a ratchet wrench 10 in accordance with a preferred embodiment of the present invention comprises a handle 20, a ratchet head 30, a screw 40 and an urging member 50.

The handle 20 is provided at one end thereof with a first pivoting wall 22 having a first through hole 221 through two opposite sides of the first pivoting wall 22, and a second pivoting wall 24 having a second through hole 242 through two opposite sides of the second pivoting wall 24 and corresponding to the first through hole 221. The first pivoting wall 22 and the second pivoting wall 24 are aligned with and spaced from each other. The first through hole 221 is a T-shaped through hole, i.e. a counterbore through hole, defining a head section 223 with a large diameter, and a shank section 225 with a small diameter. The second through hole 242 is a cylinder through hole, having an inner threaded section 244 and a smooth section 246. The lengths of the inner threaded section 244 and the smooth section 246 are respectively half of the length of the second through hole 242. In addition, the smooth section 246 of the second through hole 242 is equal in diameter to the shank section 225 of the first through hole 221.

The ratchet head 30 has a center hole 32, a plurality of teeth 34 around a periphery wall of the center hole 32, a pivoting portion 36 at a bottom thereof disposed between the first pivoting wall 22 and the second pivoting wall 24 of the handle 20, a pivoting hole 362 through two opposite sides of the pivoting portion 36 and in communication with the first through hole 221 and the second through hole 242 of the handle 20, and an accommodation chamber 364 recessed inwards in one side of the pivoting portion 362 close to the first pivoting wall 22 of the handle 20.

The screw 40 runs through the first through hole 221 of the first pivoting hole 22 of the handle 20 and the pivoting hole 362 of the ratchet head 30 and is threaded with the inner threaded section 244 of the second hole 242 of the second pivoting wall 24 of the handle 20 such that the ratchet head 30 can be configured to the handle 20 and pivotable about the screw 40 relative to the handle 20.

The urging member 50 is a spring, disposed in the accommodation chamber 364 of the ratchet head 30 and sleeved on the screw 40 and having two ends stopped against a periphery wall of the accommodation chamber 364 of the ratchet head 30 and the first pivoting wall 22 of the handle 20 for enabling the ratchet heat 30 to maintain a fixed angle without pivoting randomly.

By means of the aforesaid design, when the ratchet wrench 10 is in use, the ratchet head 30 can be adjusted to a suitable angle first according to the position of the to-be-fixed workpiece, and then the center hole 32 of the ratchet head 30 is sleeved on the workpiece to make the teeth 34 of the ratchet head 30 be engaged with the workpiece. Thereafter, the user can hold the handle 20 and force the ratchet head 30 to rotate for fixing the workpiece tightly.

Because the shank section 225 of the first through hole 221 of the first pivoting wall 22 of the handle 20 is equal in diameter to the smooth section 246 of the second through hole 242 of the second pivoting wall 24 of the handle 20 and the length of the inner threaded section 244 of the second through hole 242 of the second pivoting wall 24 of the handle 20 is half of the length of the second through hole 242 of the second pivoting wall 24 of the handle 20, the force acting on the screw 40 and produced by the periphery wall of the smooth section 246 of the second through hole 242 of the second pivoting wall 24 of the handle 20 and the force acting on the screw 40 and produced by the periphery wall of the shank section 225 of the first through hole 221 of the first pivoting wall 22 of the handle 20 are approximately equal in magnitude when the force generated by the user is transmitted from the handle 20 to the ratchet head 30 through the first pivoting wall 22 and the second pivoting wall 24. Under this circumstance, an even distribution of stress will be exerted on the screw 40 and the stress concentration will be reduced between the smooth section 246 of the second though hole 242 of the second pivoting wall 24 of the handle 20 and the screw 40, thereby effectively avoiding the screw 40 to broke and strengthening the structure strength of the ratchet wrench 10.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A ratchet wrench comprising:

a handle having two spaced pivoting walls at one end thereof facing to each other, each pivoting wall having a through hole through two opposite sides thereof, wherein a first one of the through holes has a smooth section and an inner threaded section, the inner threaded section has a length shorter than the total length of the through hole and the smooth section being formed closer to the pivoting portion of the ratchet head than the inner threaded section, and a second one of the through holes has a shank section;

a ratchet head having a pivoting portion pivotally disposed between the two pivoting walls of the handle, a pivoting hole through two opposite sides of the pivoting portion in alignment with the through holes of the handle, and an accommodation chamber recessed inwards at one side of the pivoting portion;

a single screw running through both of the through holes of the handle and the pivoting through hole of the ratchet head and threaded with the inner threaded section of the handle such that the ratchet head is pivotable about the screw relative to the handle and a non-threaded portion of the screw contacts against the smooth section of said one of the through holes; and an urging member disposed in the accommodation chamber of the ratchet head and sleeved onto the screw with two ends thereof stopped against a periphery wall of the accommodation chamber of the ratchet head and one of the pivoting walls of the handle, wherein the screw is inserted from one side of the handle, passes through both pivoting walls, and stops against the smooth section of said first one of the through holes and the smooth shank section of said second one of the through holes, such that the force acting on the screw and produced by the periphery wall of the smooth section and the force acting on the screw and produced by the periphery wall of the shank section are approximately equal in magnitude when the force generated by the user is transmitted from the handle to the ratchet head through the pivoting walls.

2. The ratchet wrench as claimed in claim 1, wherein the length of the inner threaded section of the through hole of the handle is substantially half of the total length of the through hole of the handle.

3. The ratchet wrench as claimed in claim 1, wherein the smooth section of the through hole of the one of the pivoting walls that has said inner threaded section has a diameter equal to a section of the through hole of the other one of the pivoting walls of the handle.

4. The ratchet wrench as claimed in claim 3, wherein the through hole of the one of the pivoting walls of the handle that has said inner threaded section and said smooth section is a cylinder through hole, and the through hole of the other one of the pivoting walls of the handle is a counterbore through hole defining a head section, and a shank section that has a diameter equal to that of the smooth section of the cylinder through hole.

* * * * *